US006279591B1

(12) United States Patent
Obitts

(10) Patent No.: US 6,279,591 B1
(45) Date of Patent: Aug. 28, 2001

(54) UNIVERSAL PLATFORM SUPPORT FOR A WALKER

(75) Inventor: Shane Obitts, Elyria, OH (US)

(73) Assignee: Invacare Corporation, Elyria, OH (US)

( * ) Notice: Subject to any disclaimer, the term of this patent is extended or adjusted under 35 U.S.C. 154(b) by 0 days.

(21) Appl. No.: 09/308,580

(22) PCT Filed: Apr. 15, 1998

(86) PCT No.: PCT/US98/07612

§ 371 Date: May 21, 1999

§ 102(e) Date: May 21, 1999

(87) PCT Pub. No.: WO98/46101

PCT Pub. Date: Oct. 22, 1998

Related U.S. Application Data

(60) Provisional application No. 60/043,601, filed on Apr. 15, 1997.

(51) Int. Cl.[7] ..... A61H 3/00

(52) U.S. Cl. ..... 135/67; 135/66; 135/71; 135/72; 135/73; 135/76

(58) Field of Search ..... 135/67, 71, 66, 135/72, 73, 76

(56) References Cited

U.S. PATENT DOCUMENTS

| | | | | |
|---|---|---|---|---|
| 4,248,256 | | 2/1981 | Thomas . | |
| 4,748,994 | | 6/1988 | Schultz et al. . | |
| 5,524,657 | * | 6/1996 | Jih | 135/66 |
| 5,657,783 | * | 8/1997 | Sisko | 135/67 |

* cited by examiner

*Primary Examiner*—Beth A. Stephan
(74) *Attorney, Agent, or Firm*—Hudak & Shunk Co., L.P.A.

(57) ABSTRACT

A universal platform support assembly (10) provides for vertical and horizontal adjustment to secure the assembly to a wide array of walker (W) styles and sizes. A forearm receiving member (20) can be pivoted for comfort of the user and a push handle (24) associated therewith may be selectively positioned fore and aft, as well as rotated, for additional fit and comfort. Enlarged knobs (32) that may be conveniently grasped and manipulated secure the various adjustable components together allowing assembly and adjustment to proceed without using tools.

19 Claims, 3 Drawing Sheets

UNIVERSAL PLATFORM SUPPORT FOR A WALKER

This application is a 371 of PCT/US98/07612 filed Apr. 15, 1998 and also claim benefit of Provisional No. 60/043, 601 filed Apr. 15, 1997.

BACKGROUND OF THE INVENTION

This invention relates to a patient aid and more particularly to a walker-type aid. More specifically, this invention relates to a platform support for use with a walker-type aid and will be described with particular reference thereto.

Walkers are well known in the prior art for assisting physically challenged individuals. Generally, walkers come in two sizes, i.e., an adult version and a juvenile version. Moreover, different style walkers are manufactured by a number of various companies. Walkers include four legs, two at each side. The front pair of legs are interconnected by a cross frame structure or the like. Likewise, the front and rear legs on each side are also connected by a frame structure. In foldable or collapsible walkers, the side frame assemblies can be rotated inwardly for ease of storage. In other instances, however, the side frames remain in fixed relation relative to the cross frame structure, being maintained generally parallel to one another.

The upper portion of each side frame is adapted to receive the user's hands. For example, hand grips are usually provided for comfort. Occasionally, however, a user is unable to grasp one of these hand regions and thus requires a forearm support to balance that side of the user's body and grasp the walker. Accordingly, manufacturers have provided what are generally known as platform supports.

Platform supports are typically aftermarket assemblies that may be removably secured to a side frame of the walker. The platform support is usually secured to the hand grip region, as well as to a lower, transverse support bar that extends between the front and rear legs on the side frame of the walker. Tools such as screw drivers, wrenches, and the like are required for the conventional nut and bolt type fasteners used to secure the platform support in place on the walker. Moreover, known arrangements are not conducive to fitting both the juvenile and adult sizes of walkers. Further, platform supports usually are designed for use with one style of walker. Thus, patient aid or health care dealers must keep a variety of platform support styles in inventory to accommodate the different types and styles of walkers.

It is thus desirable to provide a platform support structure that includes a universal securing arrangement. That is, it will fit both juvenile and adult sizes, as well as fit a number of different manufacturers' styles of walkers.

SUMMARY OF THE INVENTION

The present invention provides a platform support assembly that is universal, easy to adjust and assemble and economical to manufacture.

According to the present invention, a platform support for a patient aid includes a forearm receiving member. The forearm receiving member is adapted for mounting to a side frame of the patient aid via a first securing assembly that is adjustable in a generally vertical direction.

According to another aspect of the invention, a second securing assembly is adapted for mounting the forearm receiving member to a side frame of the patient aid in a manner that is adjustable in a generally horizontal direction.

In accordance with the invention, the new platform support assembly includes an adjustable three-point attachment that is adjustable. The three-point attachment preferably includes a first area along the hand grip region, and second and third attachment points preferably located along the front and rear legs. Moreover, a main support tube can be easily raised and lowered within the three-point attachment to accommodate juvenile and adult-size walkers.

Additionally, the securing assemblies preferably use enlarged, easy to manipulate connectors or knobs for securing the assembly to a walker without using tools. This facilitates converting a standard walker to a platform type support.

A principal benefit of the invention is associated with the universal adaptation of the platform support assembly to different styles and sizes of walkers.

Another benefit of the invention resides in ease with which the platform support assembly can be secured to a walker.

Yet another benefit of the invention is found in the ability to alter the positions of components to accommodate the needs and comforts of an individual user.

Still other features and benefits will become apparent to those skilled in the art upon a reading and understanding of the following specification.

BRIEF DESCRIPTION OF THE DRAWINGS

Reference may be made to the following drawings which illustrate a preferred embodiment of the invention. The drawings do not, however, limit the scope of the invention. The drawings include.

DETAILED DESCRIPTION OF THE PREFERRED EMBODIMENTS

Figure 1:
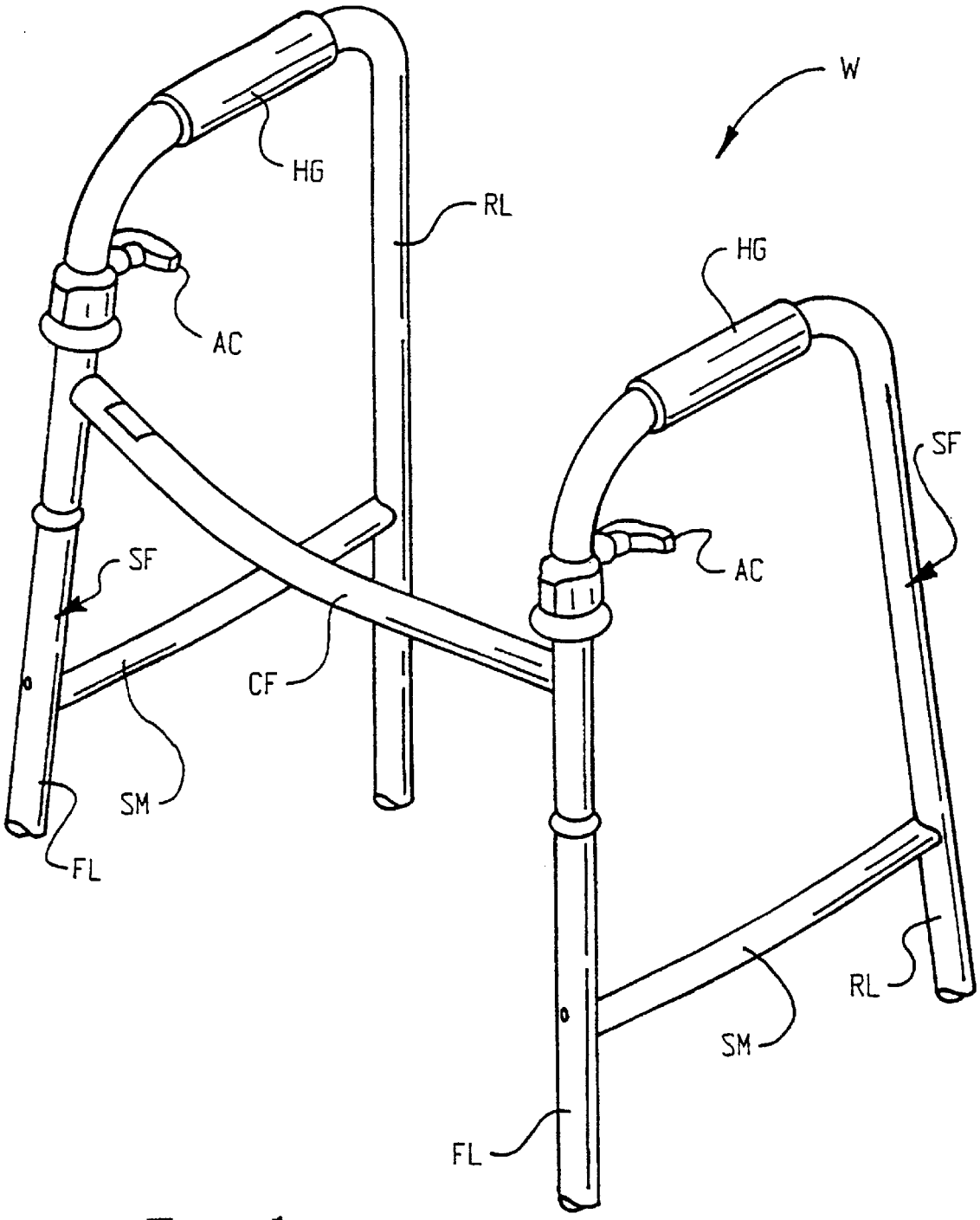
Fig. 1 Prior Art
FIG. 1 is a perspective view of an upper portion of a conventional walker.

Referring now to the drawings which illustrate the preferred embodiments of the invention only, FIG. 1 illustrates a conventional walker W having a pair of side frames SF interconnected by a cross frame member CF. Each side frame includes a front leg FL and a rear leg RL that are connected at upper ends by a hand grip region HG. Additionally, the front and rear legs are connected by a support member SM that provides additional strength and rigidity to the walker. Lower ends (not shown) of the front and rear legs may include non-slip tips or the legs may include rollers, glide members, etc., depending on the particular needs of the user.

In the walker of FIG. 1, manual actuators AC are provided on the front legs to independently fold the respective side frame into a folded, storage position adjacent the cross frame member CF from the open, operative position as illustrated. Suitable grips or cushion members GR are preferably provided in the hand grip region for grasping by a user.

Figure 2:
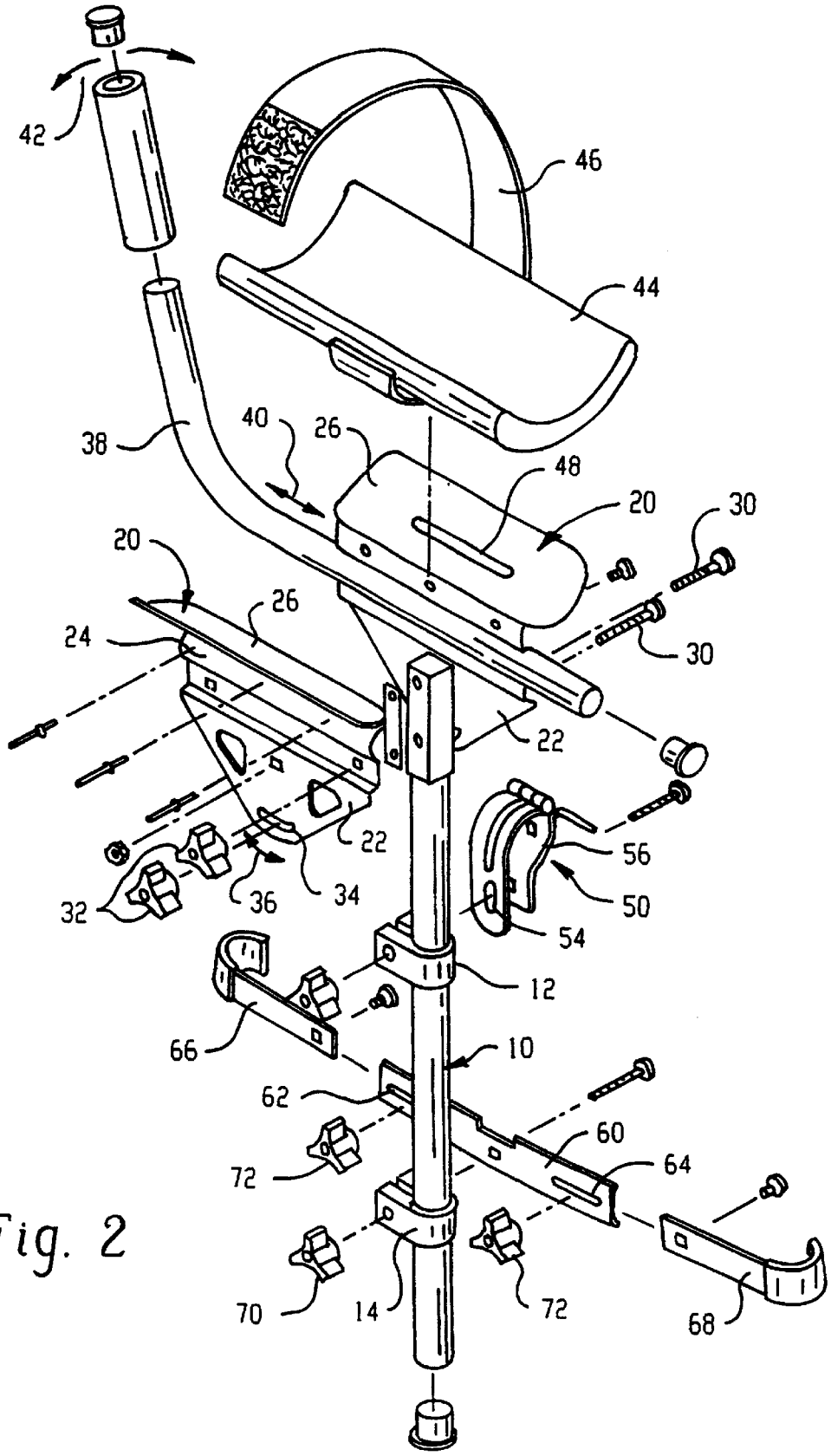
FIG. 2 is an exploded perspective view of the present invention.
Figure 4:
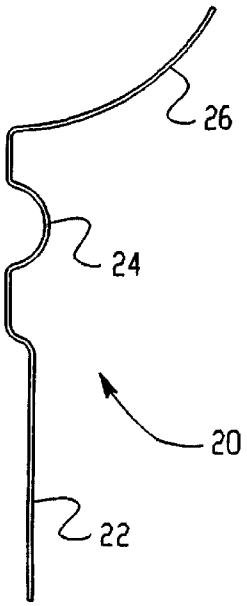
FIG. 4 is an end view taken generally from the right-hand side of FIG. 3.
Figure 3:
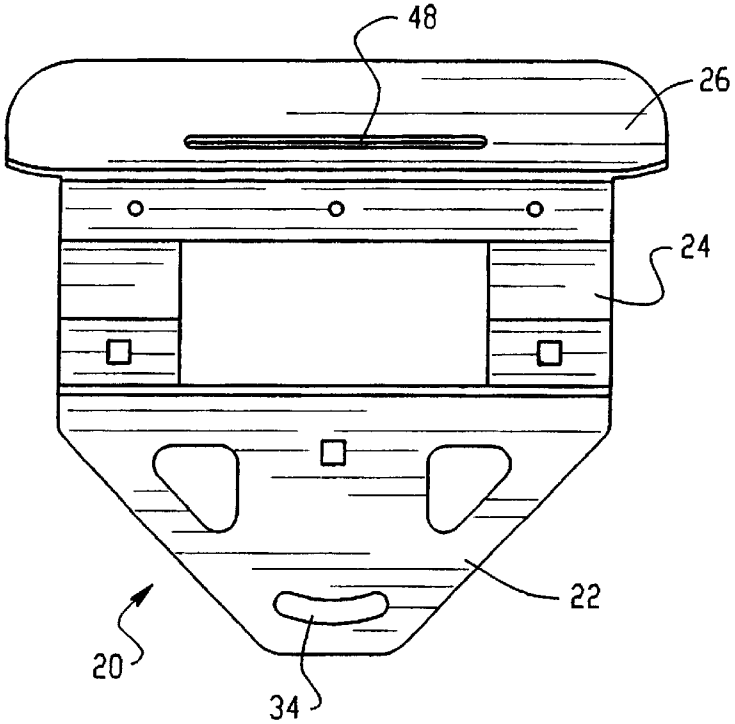
FIG. 3 is a plan view of a portion of the forearm receiving member.

FIG. 2 illustrates a preferred embodiment of the invention. The platform support assembly is adapted for use on one or both of the side frames of a conventional walker to allow a patient to manipulate the walker without grasping the hand grip. Because the angular relationship and dimension between the front and rear legs may vary from one walker to another, and likewise the location of the support member SM may also vary, the platform support assembly of the present invention is adaptable and adjustable to different sizes and styles. As shown, it includes a main support tube 10 that extends between first and second clamps 12, 14. The clamps are secured through the use of individual fasteners having enlarged handles or threaded knobs that can be easily manipulated by hand to secure the individual clamps, and thus the support tube, to an elongated clamp bracket to be described in greater detail below. At the upper end of the support tube is a two-piece arm support assembly or forearm receiving member 20. The forearm receiving member 20 is comprised of a pair of mirror-image members so that description of one is generally applicable to the other. The forearm receiving member has a triangular base portion 22, a central push-handle receiving portion 24, and an upper arm support portion 26 (see FIGS. 3 and 4). A series of fasteners 30 cooperate with threaded knobs 32 to secure the arm support assembly to an upper region of the support tube, and clamp the forearm receiving members together. An arcuate opening 34 allows the forearm receiving assembly to be selectively angularly positioned (as indicated by the directional arrows 36) on the top of the support tube for the comfort of the individual user. Thus, by loosening one of the fasteners via knob 32, the angular orientation of the forearm receiving assembly can be varied. Stated another way, it is not always desirable that the arm support be disposed orthogonal or perpendicular to the axis of the support tube. Accordingly, the arm support can be angularly positioned within the range of movement provided by the arcuate opening 34 for a limited degree of tilt.

An arm tube 38 is received between the semicircular portions that define the push-handle receiving opening 24 in the arm support assembly. As will be recognized, the arm tube 38 may be adjustably positioned fore and aft (see arrows 40) within the push-handle receiving opening so that when an individuals' forearm is resting in the upper arm support 26, the upright portion of the handle grip can be easily grasped by the user. Likewise, the arm tube can be rotated about the axis defined by the handle-receiving opening so that, if desired, further adjustment can be provided in this degree of freedom and as represented by arrows 42.

Received in the arcuate arm support is a cushion or foam member (if desired-not shown), a curvilinear upholstered arm portion 44, and a strap 46, such as a Velcro® strap, to secure the user's forearm in place. Elongated openings 48 are provided in the forearm receiving member to receive opposite ends of the strap. The straps are then slid beneath the upholstered portion to conveniently secure the individual's forearm thereto.

A clamp bracket 50 (FIG. 2) secures an upper end of the support tube 10 to the hand grip region of a conventional walker. Particularly, an elongated opening 54 is provided on the bracket to receive a fastener associated with the upper clamp 12. Moreover, this fastener also extends through a hinged clamp down member 56 adapted for receipt over the handle-receiving portion of a conventional walker. Thus, due to the hinged nature of the clamp, the bracket 50 is positioned along the outside of a side-framed walker, and the hinge portion extends over the handle into a position that is generally shown in FIG. 2 whereby it receives the fastener associated with the upper clamp. This provides a first point of attachment of the platform support to a conventional walker.

Figure 5:
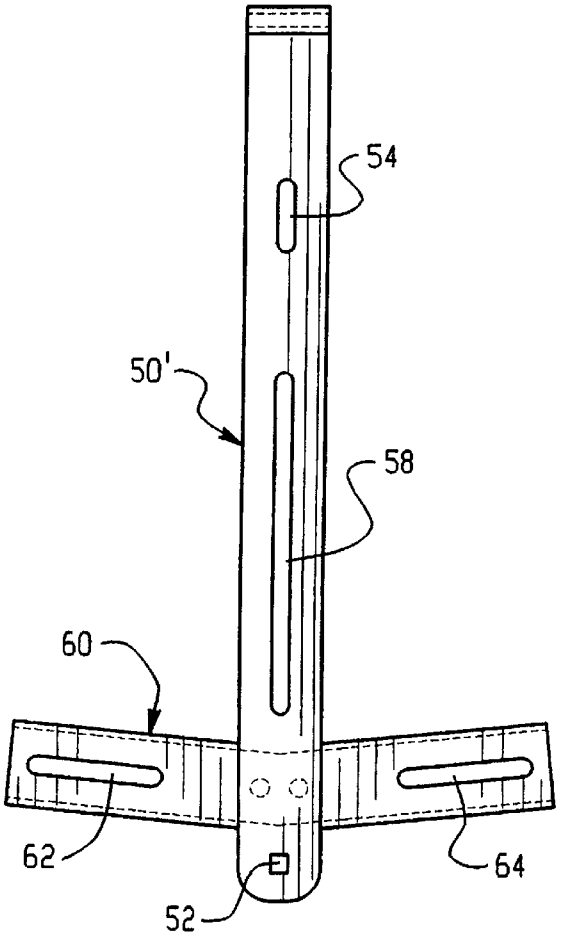
FIG. 5 is a plan view of a portion of an alternative embodiment of the platform support assembly.

In an alternative preferred embodiment of the clamp bracket designated 50' (FIG. 5), the bracket is elongated and includes an opening 52 at a lower end adapted to receive the fastener for the lower clamp 14. For reasons which will become more apparent below, this arrangement does not have as much flexibility since the second and third attachment points are constrained to a connection region on the walker within range of the elongated opening 58.

Preferably secured to a lower region of the support tube 10 is a cross bracket or member 60 that has a pair of elongated grooves 62, 64 formed in opposite ends thereof. The cross bracket receives slide members 66, 68 which have openings therein adapted to receive fasteners and enlarged threaded knobs 70, 72, respectively. The outer ends of the slide members 66, 68 preferably have an arcuate configuration adapted for receipt about the legs (front and rear) of a side frame assembly of a walker. Elongated grooves 62, 64 allow these slide members to be advanced and retracted relative to the cross bracket to accommodate different leg spacings on different manufacturer's walkers. Thus, the fastener and knob 72 and the arcuate outer ends of the slide members provide additional second and third points of attachment of the platform support to a walker.

By virtue of this assembly, a single-size platform support can accommodate both juvenile and adult-size walkers. The support tube 10 that carries the forearm receiving member can be raised and lowered relative to the clamps 12, 14 by simply loosening and tightening the knobs 18. Likewise, the forearm receiving assembly 20 can be angularly tilted by loosening and retightening knob 32, while additional knobs 32*a*, 32*b* allow the push-handle grip to be advanced forwardly and rearwardly in the handle-receiving opening, or rotated thereabout, for comfort of the user.

The entire assembly is easily secured to a side frame of a walker by folding the hinged portion of the bracket 50 about the hand grip of the walker frame. The fastener 18 associated with the upper clamp then completes the first point of attachment (and also provides for vertical adjustment, if necessary). Likewise, the slide members 66, 68 are conveniently secured about the front and rear legs of the walker on one side frame assembly, and the knobs 72 tightened to provide the second and third points of attachment (and also provide for horizontal adjustment, if necessary). Since the position of the bracket 50 and the slide members 66, 68 can be selectively altered, the platform support is adaptable to a wide variety of walker styles and sizes.

This arrangement allows the universal attachment of a platform support to a side frame assembly of a walker. It will also be understood that the same platform support can alternatively be used on either the left-hand or right-hand side frame. If necessary, platform attachments can be provided on each side frame assembly of the walker. Moreover, this structural arrangement easily accommodates both juvenile and adult versions of walkers and can be easily and conveniently fitted to a wide variety of manufacturers' structures. The enlarged threaded knobs are easily manipulated for simple adjustment, if necessary, without using any tools or special fasteners. Moreover, the three points of attachment to the conventional walker eliminates any concern with the location of the support member that interconnects the front and rear legs of a walker side frame. As may be expected, the location, size, and configuration of the support member may vary from one manufacturer to another. Thus, using the hand grip region and the front and rear legs as the preferred three points of attachment of the platform support eliminates any concerns with the various support members SM that may be used by different manufacturers.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A universal platform support for a walker-type patient aid that includes a front leg and a rear leg on each side thereof comprising:

a forearm receiving member adaptably contoured to receive a forearm of an associated user;

a support member operatively connected to and supporting the forearm receiving member;

a forearm mounting member interconnecting the forearm receiving member to the support member, the forearm mounting member including an angle adjusting portion for selectively altering the angular orientation of the forearm receiving member; and an adjustable securing assembly operatively connected to said support member having attachment members that permit adjustment of the forearm receiving member in both a generally vertical direction and a generally horizontal direction, said securing assembly including a clamp bracket adapted for receipt about a hand receiving grip of a walker-type aid.

2. The platform support of claim 1 further comprising a push handle disposed adjacent the forearm receiving member adapted for gripping by an associated user.

3. The platform support of claim 2 further comprising a push handle mounting assembly that allows selective adjustment of the push handle fore and aft relative to the forearm receiving member.

4. The platform support of claim 2 further comprising a push handle mounting assembly that allows selective rotational adjustment of the push handle relative to the forearm receiving member.

5. The platform support of claim 1 wherein the securing assembly includes an enlarged hand-manipulable knob that may be rotated to tighten and loosen the clamp bracket for adjustment without using tools.

6. The platform support of claim 1 wherein the clamp bracket is a split member having first and second portions hinged along a common edge whereby the first and second portions may be selectively opened and closed to adapt the clamp bracket for adaptable receipt about an associated hand receiving grip on a walker-type aid.

7. The platform support of claim 1 wherein the securing assembly includes first and second contoured surfaces adapted for receipt about legs of a walker-type aid.

8. The platform support of claim 7 wherein the contoured surfaces include first and second arcuate ends adapted for receipt about legs of a walker-type aid.

9. The platform support of claim 7 wherein each of the first and second contoured surfaces is independently adjustable relative to the support member in a generally horizontal direction.

10. The platform support of claim 7 including an enlarged hand-manipulable knob that may be rotated to tighten and loosen the securing assembly for generally vertical adjustment without using tools.

11. The platform support of claim 7 including first and second enlarged hand-manipulable knobs associated with the first and second contoured surfaces, respectively, that may be selectively tightened and loosened for adjusting the horizontal position of the contoured surfaces without using tools.

12. The platform support of claim 1 wherein the forearm receiving member includes first and section portions received on opposite sides of the support member and cooperatively defining an arcuate recess adapted to receive a user's forearm therein.

13. The platform support of claim 1 further including an enlarged knob for securing the forearm mounting member to the support member.

14. The platform support of claim 1 further including an enlarged knob associated with the angle adjusting portion for altering the angle of the forearm receiving member.

15. A universal platform support for a walker-type patient aid that includes a front leg and a rear leg on each side thereof comprising:

a forearm receiving member adaptably contoured to receive a forearm of an associated user;

a support member operatively connected to and supporting the forearm receiving member;

an adjustable securing assembly operatively connected to said support member having attachment members that permit adjustment of the forearm receiving member in both a generally vertical direction and a generally horizontal direction, said securing assembly including first and second members having contoured surfaces which are each adapted for receipt and attachment about a different leg of a walker-type aid.

16. The platform support of claim 15, wherein each of the first and second members having contoured surfaces is independently adjustable relative to the support member in a generally horizontal direction, and wherein said securing assembly includes a clamp bracket attachment member adapted for receipt about a hand receiving grip of a walker-type aid, said clamp bracket including an elongated slot permitting the clamp bracket to be adjusted generally vertically relative to the support member.

17. A universal platform support for a walker-type patient and comprising:

a forearm receiving member adaptably contoured to receive a forearm of an associated user, said forearm receiving member including an angle adjusting portion for selectively altering the angular orientation of the forearm receiving member;

a support member operatively connected to and supporting the forearm receiving member;

an adjustable securing assembly operatively connected to said support member having attachment members that permit adjustment of the forearm receiving member in both a generally vertical direction and a generally horizontal direction.

18. The platform support of claim 17 wherein the forearm receiving member includes first and second portions received on opposite sides of the support member and cooperatively define an arcuate recess adapted to receive a user's forearm therein.

19. The platform support of claim 17 further including an enlarged knob for securing the forearm mounting member to the support member and further including an enlarged knob associated with the angle adjusting portion for altering the angle of the forearm receiving member.

* * * * *